United States Patent [19]

Mason

[11] 3,954,175

[45] May 4, 1976

[54] ADJUSTABLE INTEGRATED CIRCUIT CARRIER

[75] Inventor: Richard Storrs Mason, Escondido, Calif.

[73] Assignee: The Singer Company, Little Falls, N.J.

[22] Filed: July 17, 1975

[21] Appl. No.: 596,963

[52] U.S. Cl. ..... 206/328; 174/52 PE; 317/101 CP; 339/17 CF; 339/17 LM; 339/17 M

[51] Int. Cl.[2] ..... B65D 73/02

[58] Field of Search ..... 206/328, 331, 332, 334; 339/17 CF, 17 LM, 17 M; 317/101 CC, 101 CP, 101 F; 174/52 R, 52 PE

[56] References Cited

UNITED STATES PATENTS

| | | | |
|---|---|---|---|
| 3,070,648 | 12/1962 | Hennessey | 206/328 |
| 3,184,699 | 5/1965 | Spera | 339/17 CF |
| 3,380,016 | 4/1968 | Samson et al. | 317/101 CP |
| 3,407,925 | 10/1968 | Ruehlemann | 206/328 |
| 3,416,122 | 12/1968 | Kinkaid | 317/101 CP |
| 3,417,865 | 12/1968 | Suverkropp et al. | 206/331 |
| 3,605,999 | 9/1971 | Coon, Jr. | 206/328 |
| 3,638,033 | 1/1972 | Johson et al. | 339/17 LM |
| 3,663,920 | 5/1972 | Lapham et al. | 339/17 CF |
| 3,747,046 | 7/1973 | Watkins et al. | 317/101 CP |
| 3,907,394 | 9/1975 | Barnes | 339/17 CF |

*Primary Examiner*—William Price
*Assistant Examiner*—Joseph M. Moy
*Attorney, Agent, or Firm*—T. W. Kennedy

[57] ABSTRACT

An improved adjustable integrated circuit carrier made in multiple pieces comprising a master base and two identical element sections which can be attached to a master base in a position determined by the dimensions of a component to be protected thereby permitting a single set of manufacturing tools to produce pieces which can be assembled to accomodate any of a wide variety of different sized components.

7 Claims, 7 Drawing Figures

ADJUSTABLE INTEGRATED CIRCUIT CARRIER

BACKGROUND OF THE INVENTION

This invention relates to carriers for retaining integrated circuits during handling, transporting, testing and stocking in general and more particularly to an improved construction of such a carrier which permits assembling carriers for a wide range of components from basic identical elements.

Integrated circuits, particlarly those referred to as LSI(Large Scale Integration) and MSI (Medium Scale Integration) packages consist of a circuit in a flat configuration with a large number of leads. Typically, such packages may have between 14 and 64 leads. After manufacture such circuits must be handled, transported, tested and placed into stock. During such handling, testing, etc., it is necessary that the circuit and its leads be protected. For this purpose various types of circuit carriers have been developed. Typical of one such carrier is that disclosed in U.S. Pat. No. 3,652,974. In the carrier disclosed therein as in other prior art carriers, only a limited range of tolerances for a given size component can be accepted. As a result separate tooling and production runs are required for each different size component. As a result, it has been the practice to manufacture a number of different sizes of carriers to handle components of established sizes. When a component is used for which no carrier exists, a new carrier must be created requiring new tooling and the resultant time delay to make a new production run of carriers or, alternatively, a different method of handling the part must be found. This has resulted in high cost and time delays or in the inability to handle or assemble the parts using automatic techniques.

In view of these problems the need for an adjustable integrated circuit carrier which can be adapted to different sizes of components and which will still adequately protect such components during handling, preferably permitting automatic handling and testing, is evident.

SUMMARY OF THE INVENTION

The present invention provides such an adjustable carrier. The carrier consists essentially of three pieces. These are a master base, and two identical moveable element sections. The two element sections are attached to the master base with a spacing determined by the dimensions of the electronic component to be protected. As a result, the master base and movable element sections can be manufactured using a single set of manufacturing tooling and then stored prior to assembly. When the carriers are required it is only necessary that a pair of movable element sections be bonded to the master base with the proper spacing to accept the component with which they are to be used.

It will be recognized, that to be usable such a carrier must have provisions for permitting the circuit to be placed into and removed from the carrier. Typically, this is carried out by having flexible beam sections which can be spread apart to permit insertion of the carrier. The flexibility is obtained through the use of a flexible plastic material. Automatic equipment exists for carrying out the necessary spreading of the retaining elements on the carrier to allow insertion and removal of the circuits. In view of this, the carrier of the present invention includes provisions for operation with such equipment. Each of the moveable element sections includes a deflectable beam on which are contained retaining hooks for the circuit. The deflectable beam has two pad extensions which are bonded to a flexible beam portion of the master base, with the main body of the moveable element sections bonded to the fixed body of the master base. In this manner conventional spreading equipment can engage a suitable opening in the master base and deflect the deflectable portions thereof which will in turn transfer the force to the deflection beam in the movable element section.

The carrier of the present invention offers numerous advantages over prior art carriers. There is a great reduction in tooling costs over what was required in the prior art where separate tooling had to be established for each different size of component. The use of the adjustable carrier of the present invention also permits automatic testing, handling and assembly techniques with nonstandard intergrated circuits which exist in small quantities and would not, in the prior art, economically justify the manufacture of special carriers. By maintaining a stock of master bases and movable elements, there is a very quick turn-around time to produce carriers for a new component when timing is critical. And, finally, components with a special or unusual configuration not conforming to that of the normal intergrated circuit can be accomodated simply by retooling the movable element only.

DETAILED DESCRIPTION OF THE PREFERRED EMBODIMENT

Figure 1:
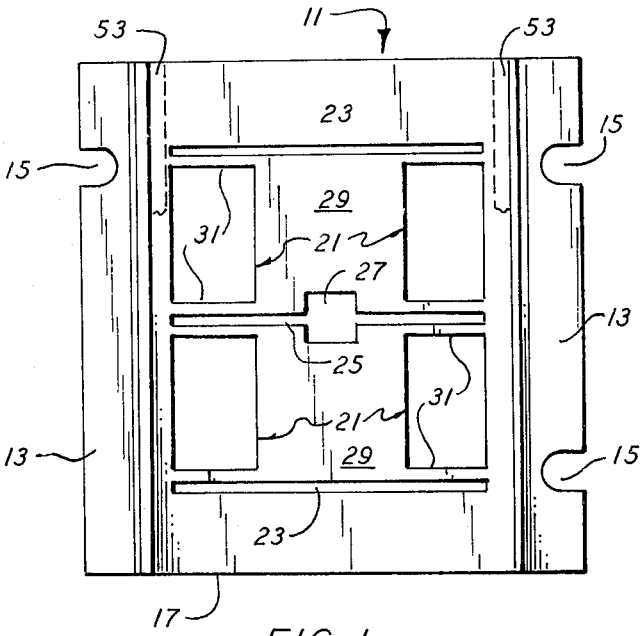
FIG. 1 is a plan view of the master base of the carrier of the present invention.
Figure 2:
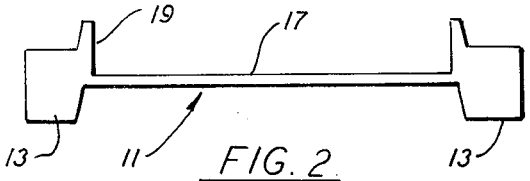
FIG. 2 is an elevation of the master base of FIG. 1.

FIG. 1 and 2 illustrate, in plan and elevation view, the master base 11 of the present invention. The master base 11 is a recessed planar member having a pair of parallel legs 13 on each side. Cutouts 15 are formed in the legs 13 to facilitate the use in various types of automatic handling and testing equipment. Disposed between the legs is a planar section 17 having side walls 19 extending above the height of the legs 13. The planar section 17 includes a plurality of cutouts. These include four rectangular cutouts 21, two elongated rectangular cutouts 23 and a central elongated cutout 25 with a larger recess 27 in the center thereof. This construction results in the formation of pads 29 each supported by four deflectable beams 31. Through insertion of a tool into the enlarged opening 27 the two pads 29 can be spread apart due to the ability of the beam 31 to deflect.

Figure 5:
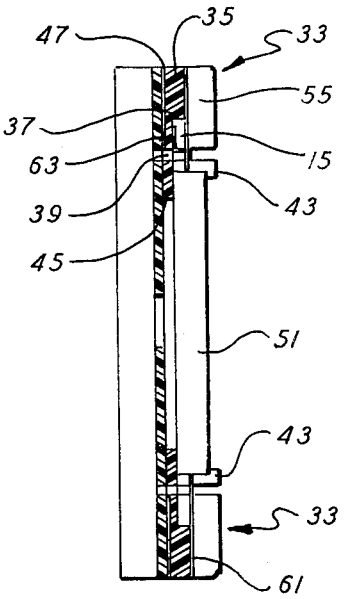
FIG. 5 is a side view in cross section of the base of FIG. 1 with the movable elements of FIG. 3 attached thereto.
Figure 3:
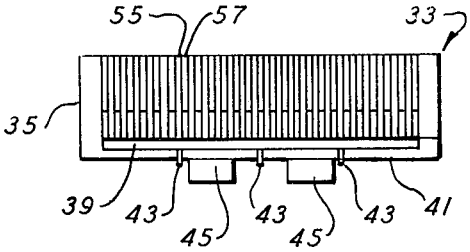
FIG. 3 is a plan view of a movable element for the carrier of the present invention.
Figure 4:
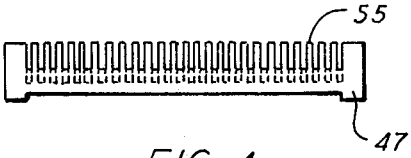
FIG. 4 is an elevation view of the movable element of FIG. 3.

FIGS. 3 and 4 are plan and elevation view respectively of the movable element of the carrier of the present invention. FIG. 5 illustrates a pair of such movable elements mounted on the base of FIGS. 1 and 2. The movable elements designated generally as 33 comprise essentially a flat base portion 35 having a step 37 resulting in a greater thickness at one end than the other. The thicker end of the base 35 is arranged toward the outside of the master base 11 as is evident from FIG. 5 and performs a function to be described in more detail below. To form a deflectable beam, a cutout 39 is made in the thinner portion of the base 35. This results in a deflectable beam 41 being formed. Projecting vertically from the deflection beams 41 are plurality of retaining hooks 43. In addition, the deflection beam 41 has attached thereto two extending pads 45. On each side of the bottom of the thicker portion of the movable element 33 is a stepped bonding pad 47. As can be seen from FIG. 5, the bottom of the bonding pad 47 is co-planar with the bottom of the beam 41 and pad 45.

The master bases 11 and the movable elements 33 are massproduced beforehand. When the dimensions of the component 51 to be handled are known, the movable elements 33 are bonded to the master base 11 with the necessary spacing so that the hooks 43 will properly retain the component 51. Bonding is done essentially in two places. Areas 53 on the master base are designated as bonding areas. The bonding pads 47 on the bottom of each of the movable elements 33 are bonded to areas 53. Although these are shown only on one side it will be recognized that bonding will take place on both sides and that the two movable elements will be symmetrically spaced on the master base 11. Also note that on the figure the movable elements 33 are shown at their maximum spacing. It will be recognized that these elements can be moved closer together to accommodate components 51 of a smaller size. The second bonding which takes place is the bonding of the pads 45 attached to the beam 41 to the pads 29 on the master base. Through these two types of bonding, the main portion 35 of the base of the movable element is bonded to the fixed portion of the master base 11. The flexible beam 41 of the movable element is bonded to the pad 29 which is itself supported flexibly on the beams 31. In this manner, insertion of a tool into the opening 27 and spreading apart of the two pads 29 will result in the beams 41 also being spread apart to open up the hook 43 to allow insertion or removal of the component 51.

In addition to the portions described so far, the movable element 33 also contains a plurality of vertical, spaced members 55 with slots 57 therebetween. These slots accommodate the leads of the integrated circuit. The step 37 permits accommodation of either nonformed leads 61 which will rest on the top of the thicker portion of the base 35 as shown on the right hand of FIG. 5, or of formed leads 63 which will rest on the narrower portion of the base 35 as shown on the lefthand side.

Figure 7:
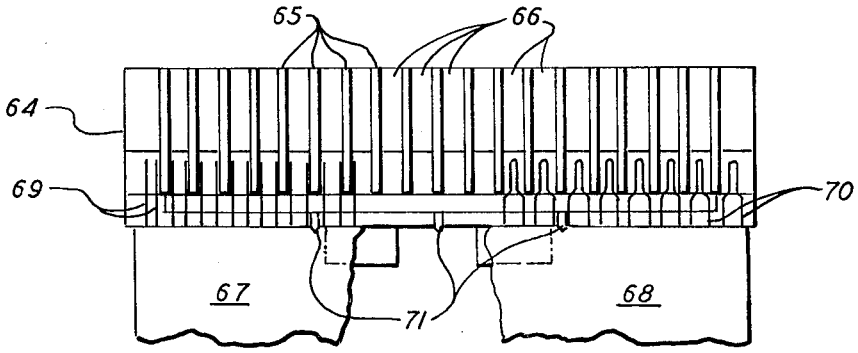
FIG. 7 is a plan view of another movable element.

An alternate construction of the movable element is shown on the plan view of FIG. 7. A movable element 64 which contains a plurality of vertical, spaced members 65 with slots 66 therebetween is shown. These vertical, spaced members 65 have a maximum dimension sufficiently small to fit between the leads 69 of a typical flatpack integrated circuit 67. The center line spacing of members 65 is equal to two times the lead spacing of this integrated circuit 67. This configuration allows the same movable element 65 to accommodate dual-in-line packaged integrated circuits 68 with preformed leads 70.

In use a conventional flat packaged integrated circuit 67 is installed in the carrier with two leads 69 located in each space 66, protected by vertical, spaced members 65. The component retaining hooks 71 are located midway between adjacent leads 69 and retain the body of the component 67 in the manner previously described. The leads 69 can be either straight like leads 61 of FIG. 5, or preformed like leads 63 of FIG. 5.

For use with a dual-in-line packaged integrated circuit 68, the leads are first preformed similar to leads 63 of FIG. 5. The integrated circuit 68 is then placed in the carrier so that each lead 70 is centered in a space 66, protected by vertical, spaced members 65. The retaining hooks 71 are located midway between adjacent leads 70 and retain the body of the component 68 as earlier described.

Typically flat packaged integrated circuits 67 have leads 69 which are 0.020 inch wide on 0.050 inch centers, and dual-in-line packaged integrated circuits 68 have leads 70 which are 0.070 inch wide maximum on 0.100 inch centers. Therefore, typical dimensions for fabrication of this movable element 64 are vertical, spaced elements 65 with a maximum width of 0.025 inch located on 0.100 centers. This leaves spaces 66 of 0.075 inch minimum to accomodate leads.

The illustrated embodiment can typically have an overall dimension of 2½ × 2½ inches and is capable of accepting a maximum of 80 leads, 40 on each side. For flat packaged IC's, or 40 leads, 20 on a side for dual-in-line packaged IC's. Typically it will be designed to accept a component with a maximum width of 2.0 inches and a maximum length of 1.5 inches and a minimum length of 0.20 inches. With the dimensioning shown on the figure, the hooks 53 will accept components with a thickness up to 0.170 inches. However, by using a different movable element, greater thicknesses can be accommodated. Note, that in such a case the same base 11 would be usable and only new movable elements 33 need be manufactured.

Figure 6:
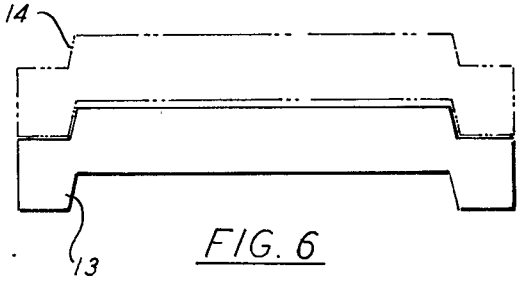
FIG. 6 is a view illustrating the manner in which the carriers of the present invention can be stacked.

After manufacture, component 51, 67 or 68 can be inserted into suitably assembled carriers using automatic equipment. Thereafter they can be rapidly and accurately handled using automatic test and manufacturing equipment. In addition, as shown by FIG. 6, the aggrangement of the legs 13 and the walls 19 is such that a plurality of carriers, containing therein components 51, 57 or 68 can be stacked one on top of the other so that they can be transported so stacked in protective magazines. A typical series of operations will be as follows: the carrier will be put in place and a tool inserted in the opening 27 spreading apart the hooks 43 whereupon the component will then be transported to a test area where the integrated circuit component will be thoroughly tested; and, after components are tested, they will be automatically stacked in magazines as indicated above. Typically this will be done prior to assembly of the integrated circuit into a system. When it comes time to assemble the integrated circuit into a larger system, the carriers will be transported to the appropriate location, a tool again inserted in the opening 27 to spread apart the hook 43, and the component removed and put in place. The carrier is then available to be used again.

I claim:

1. An adjustable integrated circuit carrier comprising:

a. a master base having a fixed portion and first and second flexible portions capable of being moved apart;

b. first and second movable elements each including a fixed portion and a portion flexibly attached thereto, said flexible portion containing thereon a plurality of retaining means; and c. said first and second movable elements bonded to said master base, with the fixed portion of said movable element bonded to the fixed portion of said master base and the flexible portions of said movable element bonded respectively to said first and second movable portions of said master base, with the retaining means on said movable elements spaced apart a distance so as to accept an integrated circuit of a predetermined width.

2. An integrated circuit carrier comprising:

a. a master base comprising:

1. a rectangular planar member;
2. first and second pads in the central portion of said planar member supported so as to be deflectable in the plane thereof; and
3. means to permit engagement of said pads to cause them to deflect apart;

b. first and second movable elements each comprising a fixed base and a deflectable beam extending therefrom; and c. said fixed base of each of said movable elements being bonded to said planar member at a position other than on said deflectable pads, with the deflectable beam of said first movable element bonded to said first pad and the deflectable beam of said second movable element bonded to said second pad, said deflectable beams containing thereon retaining means for an integrated circuit, said first and second movable elements being bonded so that the spacing between their respective retaining means correspond to the width of a predetermined integrated circuit to be retained in the carrier.

3. Apparatus as in claim 2 wherein each of said pads is supported by four deflectable beam sections coupling it to the remainder of said planer member and wherein said means to permit deflecting said pads comprising an opening between two opposing pads into which a tool can be inserted to spread said pads apart.

4. Apparatus as in claim 3 wherein each of said movable elements further includes a plurality of spaced vertical members extending from said fixed base and defining therebetween a plurality of slots for accepting leads from an intergrated circuit.

5. Apparatus as in claim 4 wherein said fixed base of said movable element contains a step, the lower portion of said step disposed toward the inside, whereby said lower portion can except formed leads and the higher portion of said step can support nonformed leads.

6. Apparatus as in claim 3 wherein said planar member is supported on parallel legs each leg having a downward extending portion and an upward extending portion forming a wall adjacent to planar member and wherein said downward extending legs are spaced so as to permit fitting over said upwardly extending side walls to permit stacking of a plurality of said carriers.

7. Apparatus as in claim 4 wherein the spacing of said vertical members is such as to define slots which will accept the leads of both a flat packaged and a dual-in-line packaged integrated circuit.

* * * * *